US010117501B2

(12) United States Patent
Marui

(10) Patent No.: US 10,117,501 B2
(45) Date of Patent: Nov. 6, 2018

(54) PORTABLE BAG WITH ADJUSTABLE INNER CONTAINER

(71) Applicant: Shinji Marui, Kobe (JP)

(72) Inventor: Shinji Marui, Kobe (JP)

( * ) Notice: Subject to any disclaimer, the term of this patent is extended or adjusted under 35 U.S.C. 154(b) by 84 days.

(21) Appl. No.: 15/181,990

(22) Filed: Jun. 14, 2016

(65) Prior Publication Data

US 2016/0360865 A1 Dec. 15, 2016

(30) Foreign Application Priority Data

Jun. 14, 2015 (JP) ..... 2015-119848

(51) Int. Cl.
*A45F 3/04* (2006.01)

(52) U.S. Cl.
CPC ..... *A45F 3/04* (2013.01)

(58) Field of Classification Search
CPC ..... A45F 3/04
USPC ..... 224/148.1; 383/37–40
See application file for complete search history.

(56) References Cited

U.S. PATENT DOCUMENTS 4,887,751 A * 12/1989 Lehman ..... A45C 5/14 190/1
5,806,740 A * 9/1998 Carlson ..... A45F 3/047 224/259
6,298,993 B1 * 10/2001 Kalozdi ..... A45C 3/00 150/106
7,931,178 B2 * 4/2011 Rome ..... A45F 3/04 206/315.3
8,172,117 B2 * 5/2012 Maggi ..... A45F 3/047 224/263
9,200,871 B2 * 12/2015 Hexels ..... A45F 3/06
2008/0302839 A1 * 12/2008 Murdoch ..... A45F 3/04 224/153
2016/0113365 A1 * 4/2016 Lank ..... A45C 3/00 383/40

* cited by examiner

*Primary Examiner* — Peter Helvey
(74) *Attorney, Agent, or Firm* — Innovation Capital Law Group, LLP; Vic Lin

(57) ABSTRACT

A portable bag includes an outer main body and an inner bag that can hold dry or wet contents. An inner bag adjustment mechanism adjusts the vertical, lateral and forward-rearward positions of the inner bag with respect to the outer main body such that the inner bag may be positioned anywhere within the main body. Releasable securing mechanisms and biasing mechanisms help fix the inner bag at the desired vertical and lateral position.

19 Claims, 8 Drawing Sheets

PORTABLE BAG WITH ADJUSTABLE INNER CONTAINER

BACKGROUND OF THE INVENTION

1. Field of the Invention

The invention relates generally to wearable bags and packs, particularly for exercising and sporting activities.

2. Description of Prior Art and Related Information

Backpacks worn while exercising can help carry reservoirs of potable water. When a bag is shaken, such as during intense physical activity, the reservoir within may swing vertically and horizontally, burdening the user.

Conventional backpacks have partitions to separate the reservoir from the rest of the contents within the bag. However, there are limits to the positions to which the partitions may be set in conventional bags.

SUMMARY OF THE INVENTION

In accordance with the present invention, structures and associated methods are disclosed which address these needs and overcome the deficiencies of the prior art.

A preferred wearable bag apparatus comprises an outer bag and an inner reservoir to be adjusted and positioned anywhere within the outer bag.

In one aspect, a bag apparatus comprises an outer main body and an inner bag, or container, disposed within the main body. An inner bag adjustment mechanism is coupled to the inner bag and configured to steplessly move and fix the inner bag both vertically with respect to the outer main body.

The inner bag adjustment mechanism comprises a first belt configured to adjust a vertical position of the inner bag with respect to the outer main body. A second belt is configured to adjust a lateral position of the inner bag with respect to the outer main body. The first belt is coupled to the inner bag. The second belt moves the first belt laterally towards the right or left side of the main body.

The apparatus further comprises a first securing mechanism to releasably fix the inner bag at the vertical position. The first securing mechanism may comprises a first plurality of hook-and-loop fasteners formed on a handle of the first belt. The apparatus further comprises a second securing mechanism to releasably fix the inner bag at the lateral position. The second belt comprises a ring through which the first belt passes, the ring moving the first belt laterally so as to adjust the lateral position of inner bag.

The apparatus further comprises a pair of shoulder straps having a second plurality of hook-and-loop fasteners, wherein the first plurality of hook-and-loop fasteners may be releasably coupled to the second plurality of hook-and-loop fasteners.

A biasing mechanism may be coupled to the second belt to bias the inner bag laterally with respect to the main body. The inner bag adjustment mechanism may be employed while the bag apparatus is worn. The inner bag may be adjustable in size.

In a further aspect, a bag apparatus comprises an outer main body, an inner bag disposed within the main body, and an inner bag adjustment mechanism coupled to the inner bag and configured to move the inner bag both vertically and laterally with respect to the outer main body. A first securing mechanism releasably fixes the inner bag at a desired vertical position. The inner bag adjustment mechanism may comprise a first belt configured to adjust a vertical position of the inner bag with respect to the outer main body and a second belt configured to adjust a lateral position of the inner bag with respect to the outer main body. The first belt is coupled to the inner bag and the second belt moves the first belt laterally towards the right or left side of the main body.

The first securing mechanism may comprise a first plurality of hook-and-loop fasteners formed on a handle of the first belt, the apparatus further comprising a pair of shoulder straps having a second plurality of hook-and-loop fasteners, wherein the first plurality of hook-and-loop fasteners may be releasably coupled to the second plurality of hook-and-loop fasteners. A second securing mechanism releasably fixes the inner bag at a desired lateral position.

The second belt may comprise a ring through which the first belt passes, the ring moving the first belt laterally so as to adjust the lateral position of inner bag.

The apparatus may further comprise a biasing mechanism coupled to the first belt as well as a second biasing mechanism coupled to the second belt.

In a further aspect, a bag apparatus comprises an outer main body, an inner bag disposed within the main body, an inner bag adjustment mechanism coupled to the inner bag and configured to move the inner bag both vertically and laterally with respect to the outer main body, a first securing mechanism to releasably fix the inner bag at a desired vertical position, a second securing mechanism to releasably fix the inner bag at a desired lateral position, and a pair of shoulder straps. The inner bag adjustment mechanism comprises a first belt configured to adjust a vertical position of the inner bag with respect to the outer main body and a second belt configured to adjust a lateral position of the inner bag with respect to the outer main body. The first belt is coupled to the inner bag and the second belt moves the first belt laterally towards the right or left side of the main body.

The first securing mechanism comprises a first plurality of hook-and-loop fasteners formed on a handle of the first belt. The pair of shoulder straps comprise a second plurality of hook-and-loop fasteners such that the first plurality of hook-and-loop fasteners may be releasably coupled to the second plurality of hook-and-loop fasteners. The second belt comprises a ring through which the first belt passes, the ring moving the first belt laterally so as to adjust the lateral position of inner bag. The apparatus may further comprise a biasing mechanism coupled to the second belt.

In summary, a portable bag includes an outer main body and an inner bag that can hold dry or wet contents. An inner bag adjustment mechanism adjusts the vertical, lateral and forward-rearward positions of the inner bag with respect to the outer main body such that the inner bag may be positioned anywhere within the main body. Releasable securing mechanisms and biasing mechanisms help fix the inner bag at the desired vertical and lateral position.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
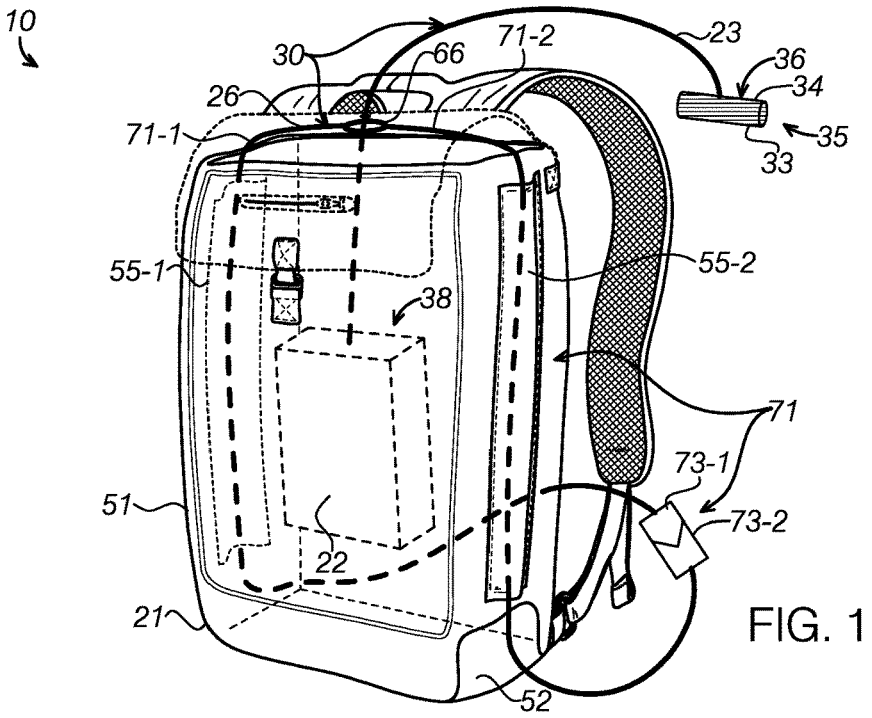
FIG. 1 is a rear perspective view of a first preferred embodiment of a backpack comprising an inner bag position adjustment mechanism.
Figure 2:
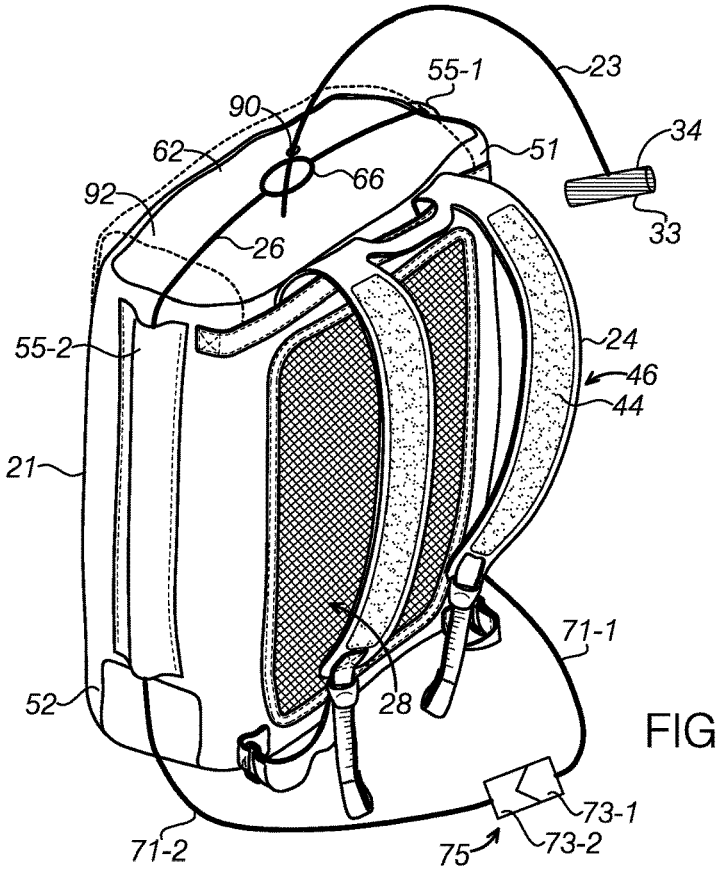
FIG. 2 is right perspective view of the first preferred embodiment of the backpack.

A first preferred embodiment of a wearable backpack apparatus, or simply pack, 10 is illustrated in FIGS. 1 and 2. In FIG. 1, the pack 10 comprises an outer main body 21 containing an inner bag, or inner container, 22. A pair of shoulder straps 24 are coupled to a user-facing vertical side 28 of the pack 10. The inner bag 22 is configured to hold fluids as well as dry contents.

An inner bag adjustment mechanism 30 steplessly adjusts both the vertical and horizontal position of the inner bag 22, thereby positioning the inner bag 22 at any desired position within the main body 21. As used throughout the specification, "stepless" refers to a non-metered, non-incremental adjustment and positioning of the inner bag as opposed to inner bags in the prior art which can be vertically adjusted one step at time at fixed vertical positions. The stepless vertical and horizontal adjustment of the inner bag 22 according to the preferred embodiment enables the inner bag 22 to be moved and fixed in position at any desired vertical and horizontal position with respect to the main body 21. In particular, the vertical adjustment of the inner bag 22 with respect to the outer body 22 in the preferred embodiment is not limited to steps, or pre-configured vertical heights.

The inner bag adjustment mechanism 30 comprises a first belt 23 and a second belt 26. The first belt 23 comprises a height adjusting belt, or vertically adjusting belt, 23 that raises or lowers the inner bag 22 with respect to the main body 21. The second belt 26 comprises a laterally adjusting belt 26 that moves the inner bag 22 sideways in relation to the main body 21. Therefore, the first belt 23 and second belt 26 respectively adjust the vertical and horizontal position of the inner bag 22 with respect to the main body 21. In FIG. 2, the vertically adjusting belt 23 may extend through a hole 90 formed in a top flap 92 of the outer body 21.

A handle 33 is coupled to a first outer end 35 of the height adjusting belt 23 disposed outside of the main body 21. The first belt 23 may comprise a first securing mechanism, or releasable locking mechanism, 34 to lock or fix the vertical position of the inner bag 22. In the preferred embodiment, the securing mechanism 34 comprises hook-and-loop fasteners 34 covering the outer surface 36 of the handle 33. In FIG. 2, each shoulder strap 24 preferably comprises hook-and-loop fasteners 44 on an external non-contact surface 46 such that the handle 33 may be coupled anywhere along the length of the shoulder strap 24, thereby fixing the vertical position of the inner bag 22. A second inner end 38 of the vertically adjusting belt 23 is coupled to a top of the inner bag 22.

In FIGS. 1 and 2, tubes 55-1 and 55-2 are coupled to a left side 51 and right side 52, respectively, of the main body 21 for slidably receiving portions of the laterally adjusting belt 26. In the preferred embodiment, the tubes 55-1, 55-2 may be composed of a resin material. A central ring 66 is preferably positioned generally along a mid-portion of the laterally adjusting belt 26 such that the central ring 66 sits adjacent to a top portion 62 of the main body 22 when the laterally adjusting belt 26 is properly fitted. The vertically adjusting belt 23 intersects and passes through the centrally positioned ring 66. In the preferred embodiment, the ring 66 may be composed of a resin material.

In the preferred embodiment, a second securing mechanism 71 comprises a pair of belt sections 71-1, 71-2 that extend away from the ring 66 and downwardly into the pair of tubes 55-1, 55-2 coupled to the sides of the main body 21. In particular, a first belt section 71-1 extends through the left tube 55-1 out the bottom while the second belt section 71-2 extends through the right tube 55-2. The tubes 55-1, 55-2 may comprise waterproof material and thus serve as waterproof covers, or housing, for the belts. Additional waterproof covers may be provided for the vertically adjusting belt 23 such that each maneuverable belt is protected from water.

The belt sections 71-1, 71-2 terminate beneath the tubes 55-1, 55-2 at first and second belt buckle portions 73-1, 73-2, respectively, which collectively form a clasp 75 which can be connected or detached. The tubes 55-1, 55-2 and clasp 75 collectively form the second securing mechanism 71 that helps keep the inner bag 22 at a desired lateral position.

In operation, a user adjusts the vertical position of the inner bag 22 with respect to the main body 1 by pulling the vertically adjusting belt 23 to raise the inner bag 22, or letting go of the vertically adjusting belt 23 to lower the inner bag 22 by way of its own weight. The user adjusts the lateral position of the inner bag 22 with respect to the main body 21 by tugging either the moving the left belt section 71-1 or the right belt section 71-2. Pulling the left belt section 71-1 moves the ring 66 towards the left side 51 of the main body 21, thereby carrying the vertically adjusting belt 23 and thus the attached inner bag 22 toward the left. Similarly, pulling the right belt section 71-2 moves the ring 66 towards the right side 51 of the main body 21, thereby carrying the vertically adjusting belt 23 and thus the attached inner bag 22 toward the right.

It will be appreciated that the inner bag 22 may be steplessly moved vertically and/or horizontally anywhere within the main body 21 by using the vertically adjusting belt 23 and the laterally adjusting belt 26. In particular, the positioning of the inner bag 22 within the main body 21 is not limited by partitions, steps or any other incremental positions. It will further be appreciated that the user may operate the inner bag adjustment mechanism 30 while wearing the pack.

Figure 3:
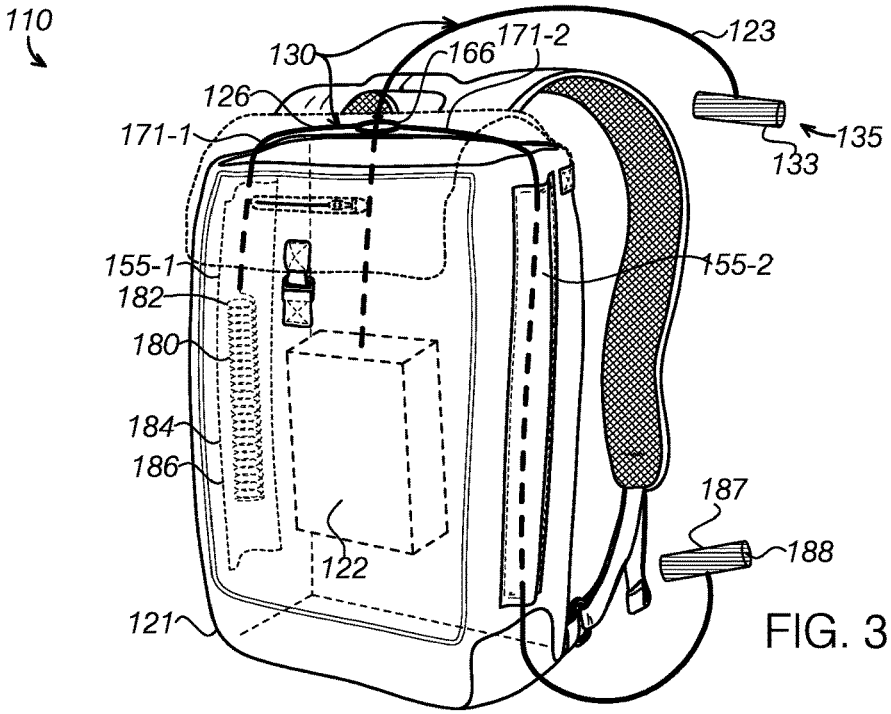
FIG. 3 is a rear perspective view of a second preferred embodiment of a backpack comprising an inner bag position adjustment mechanism.
Figure 4:
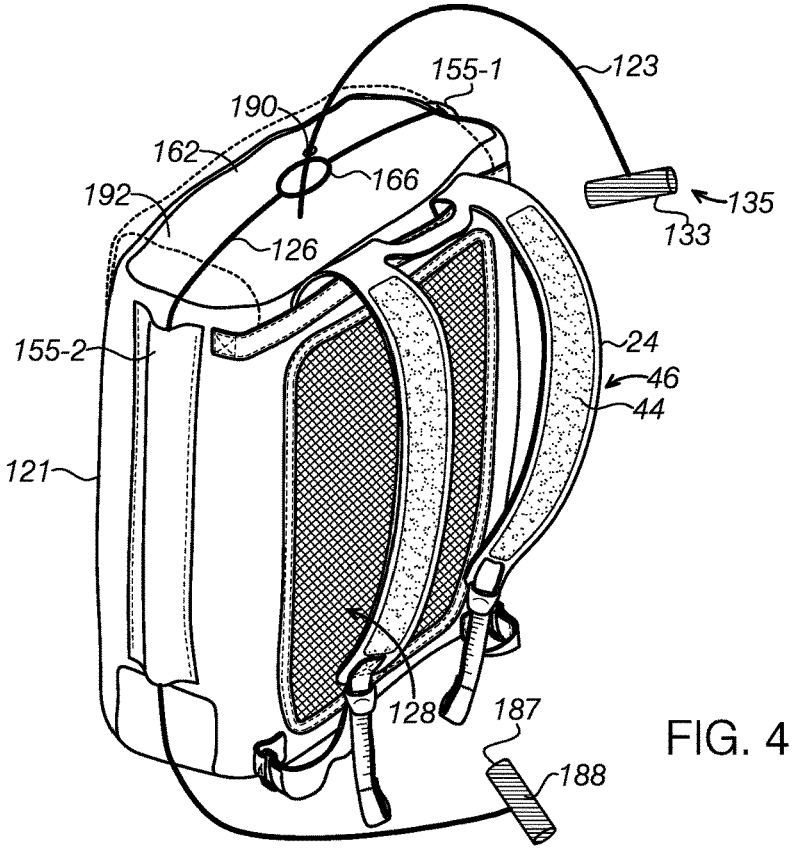
FIG. 4 is a right perspective view of the second preferred embodiment of the backpack.

In FIGS. 3 and 4, a second preferred embodiment of a pack 110 is illustrated. In FIG. 3, the pack 110 comprises an outer main body 121 containing an inner bag 122. A pair of shoulder straps 124 are coupled to a user-facing vertical side 128 of the pack 110.

An inner bag adjustment mechanism 130 comprises a first belt 123 and a second belt 126. The first belt 123 comprises a height adjusting belt, or vertically adjusting belt, 123 that raises or lowers the inner bag 122 with respect to the main body 121. The second belt 126 comprises a laterally adjusting belt 126 that moves the inner bag 122 sideways in relation to the main body 121. Therefore, the first belt 123 and second belt 126 respectively adjust the vertical and horizontal position of the inner bag 122 with respect to the main body 121.

A first handle 133 is coupled to a first outer end 135 of the height adjusting belt 123 disposed outside of the main body 121. The first handle 133 may comprise hook-and-loop fasteners 134 covering the outer surface 136. A second inner end 138 of the vertically adjusting belt 123 is coupled to a top of the inner bag 122. In FIG. 4, the vertically adjusting belt 123 may extend through a hole 190 formed in a top flap 192 of the outer body 21.

In FIG. 4, each shoulder strap 124 preferably comprises hook-and-loop fasteners 144 on an external non-contact surface 146 such that the first handle 133 may be coupled anywhere along the length of the shoulder strap 124, thereby fixing the vertical position of the inner bag 122.

In FIGS. 3 and 4, tubes 155-1 and 155-2 are coupled to a left side 151 and right side 152, respectively, of the main body 121 for slidably receiving portions of the laterally adjusting belt 126. In the preferred embodiment, the tubes 155-1, 155-2 may be composed of a resin material. A central ring 166 is preferably positioned generally along a mid-portion of the laterally adjusting belt 126 such that the central ring 166 sits adjacent to a top portion 162 of the main body 122 when the laterally adjusting belt 126 is properly fitted. The vertically adjusting belt 123 intersects and passes through the centrally positioned ring 166. In the preferred embodiment, the ring 166 may be composed of a resin material.

The laterally adjusting belt 126 further comprises a pair of belt sections 171-1, 171-2 that extend away from the ring 166 and downwardly into the pair of tubes 155-1, 155-2 coupled to the sides of the main body 21. In particular, a first belt section 171-1 extends partially through the left tube 155-1 and is coupled to a biasing mechanism 180 disposed towards the bottom 181 of the left tube 155-1. In particular, a top portion 182 of the biasing mechanism 180, which may preferably comprise a spring mechanism, is coupled to the left belt section 171-1 while a bottom portion 184 of the spring mechanism 180 is coupled to an attachment 186 at the bottom 181 of the left tube 155-1. The spring mechanism 180 biases the first belt section 171-1 downwardly, thereby biasing the laterally adjusting belt 126 to the left. In the illustrated embodiment, the spring mechanism 180 biases the inner bag 122 laterally. It will be appreciated that the spring mechanism 180 may be positioned on the right side of outer main body 121 to laterally bias the inner bag 122 towards the right of the outer main body 121. In other embodiments, the spring mechanism may be coupled to a top of the inner bag 122 and to the vertically adjusting belt 123 so as to bias the inner bag 122 upwardly against gravity.

The second belt section 171-2 extends through the right tube 155-2, out of the bottom of the tube 155-2 and terminates at a second handle 187. In the preferred embodiment, the second handle 187 comprises hook-and-loop fasteners 188 substantially covering the outer surface of the second handle 184. Thus, the second handle 187 may be coupled to any portion of the outer surface of either shoulder strap 124.

In operation, a user adjusts the vertical position of the inner bag 122 with respect to the main body 121 by pulling the vertically adjusting belt 123 to raise the inner bag 122, or letting go of the vertically adjusting belt 123 to lower the inner bag 122 by way of its own weight. The user adjusts the lateral position of the inner bag 122 with respect to the main body 121 by pulling the right belt section 171-2 or allowing the spring mechanism 180 to pull the laterally adjusting belt 126 to the left. Pulling the right belt section 171-2 moves the ring 166 towards the right side 152 of the main body 121, thereby carrying the vertically adjusting belt 123 and thus the attached inner bag 122 toward the right. Loosening or letting go of the right belt section 171-2 enable the spring mechanism 180 to retract to its default position, pulling the ring 166 towards the left side 151 of the main body 121.

It will be appreciated that in the second preferred embodiment, the inner bag 122 may be moved vertically and/or horizontally anywhere within the main body 121 by using the vertically adjusting belt 123 and the laterally adjusting belt 126. In particular, the positioning of the inner bag 122 within the main body 121 is not limited by partitions, steps or any other incremental positions.

Figure 5:
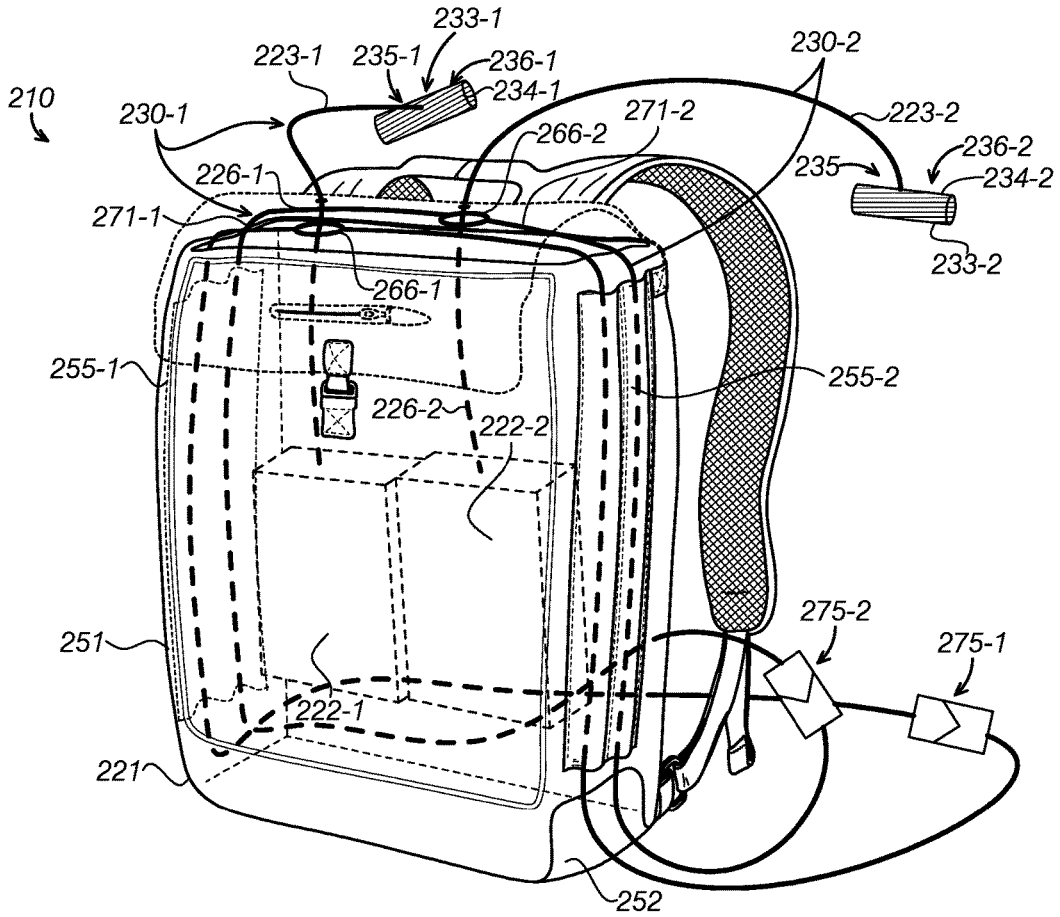
FIG. 5 is a rear perspective of a third preferred embodiment of the backpack.

In FIG. 5, a third preferred embodiment of a pack 210 comprises an outer body 221 containing multiple inner bags, such as a first inner bag 222-1 and a second inner bag 222-2. A pair of shoulder straps 224 are coupled to the outer body 221.

A first inner bag adjustment mechanism 230-1 controls the positioning of the first inner bag 222-1 comprises a first pair of belts 223-1, 226-1. The first height adjusting belt, or vertically adjusting belt, 223-1 raises or lowers the first inner bag 222-1 with respect to the main body 221. The first laterally adjusting belt 226-1 moves the first inner bag 222-1 sideways in relation to the main body 221. Therefore, the first height adjusting belt 223-1 and first laterally adjusting belt 126-1 respectively adjust the vertical and horizontal position of the first inner bag 222-1 with respect to the main body 221.

A first belt handle 233-1 is coupled to a first outer end 235-1 of the first height adjusting belt 223-1 disposed outside of the main body 221. The first belt handle 233-1 may comprise hook-and-loop fasteners 234-1 covering the outer surface 236-1. An inner end 238-1 of the first vertically adjusting belt 223-1 is coupled to a top of the first inner bag 222-1.

A second inner bag adjustment mechanism 230-2 controls the positioning of the second inner bag 222-1 comprises a second pair of belts 223-2, 226-2. The second height adjusting belt, or vertically adjusting belt, 223-2 raises or lowers the second inner bag 222-2 with respect to the main body 221. The second laterally adjusting belt 226-2 moves the second inner bag 222-2 sideways in relation to the main body 221. Therefore, the second height adjusting belt 223-2 and second laterally adjusting belt 226-2 respectively adjust the vertical and horizontal position of the second inner bag 222-2 with respect to the main body 221.

A second belt handle 233-2 is coupled to an outer end 235 of the second height adjusting belt 223-2 disposed outside of the main body 221. The second belt handle 233-2 may comprise hook-and-loop fasteners 234-2 covering the outer surface 236-2. An inner end 238-2 of the second vertically adjusting belt 223-1 is coupled to a top of the second inner bag 222-1.

Each shoulder strap 224 preferably comprises hook-and-loop fasteners 244 on an external non-contact surface 246 such that the first handle 233 may be coupled anywhere along the length of the shoulder strap 124, thereby fixing the vertical position of the inner bag 122.

A left tube 255-1 and a right tube 255-2 are coupled to a left side 251 and right side 252, respectively, of the main body 221 for slidably receiving portions of the laterally adjusting belts 226-1, 226-2. In the preferred embodiment, the tubes 255-1, 255-2 may be composed of a resin material. A first central ring 266-1 is preferably positioned generally along a mid-portion of the first laterally adjusting belt 226-1 such that the first central ring 266-1 sits adjacent to a top portion 262 of the main body 222 when the first laterally adjusting belt 226-1 is properly fitted. The first vertically adjusting belt 223-1 intersects and passes through the centrally positioned first ring 266-1. A second central ring 266-2 is preferably positioned generally along a mid-portion of the second laterally adjusting belt 226-2 such that the second central ring 266-2 sits adjacent to a top portion 262 of the main body 222 when the second laterally adjusting belt 226-2 is properly fitted. The second vertically adjusting belt 223-2 intersects and passes through the centrally positioned second ring 266-2. In the preferred embodiment, the rings 266-1, 266-2 may be composed of a resin material.

A first clasp 275-1 is coupled to the first laterally adjusting belt 226-1, and a second clasp 275-2 is coupled to the second laterally adjusting belt 226-2.

Figure 6:
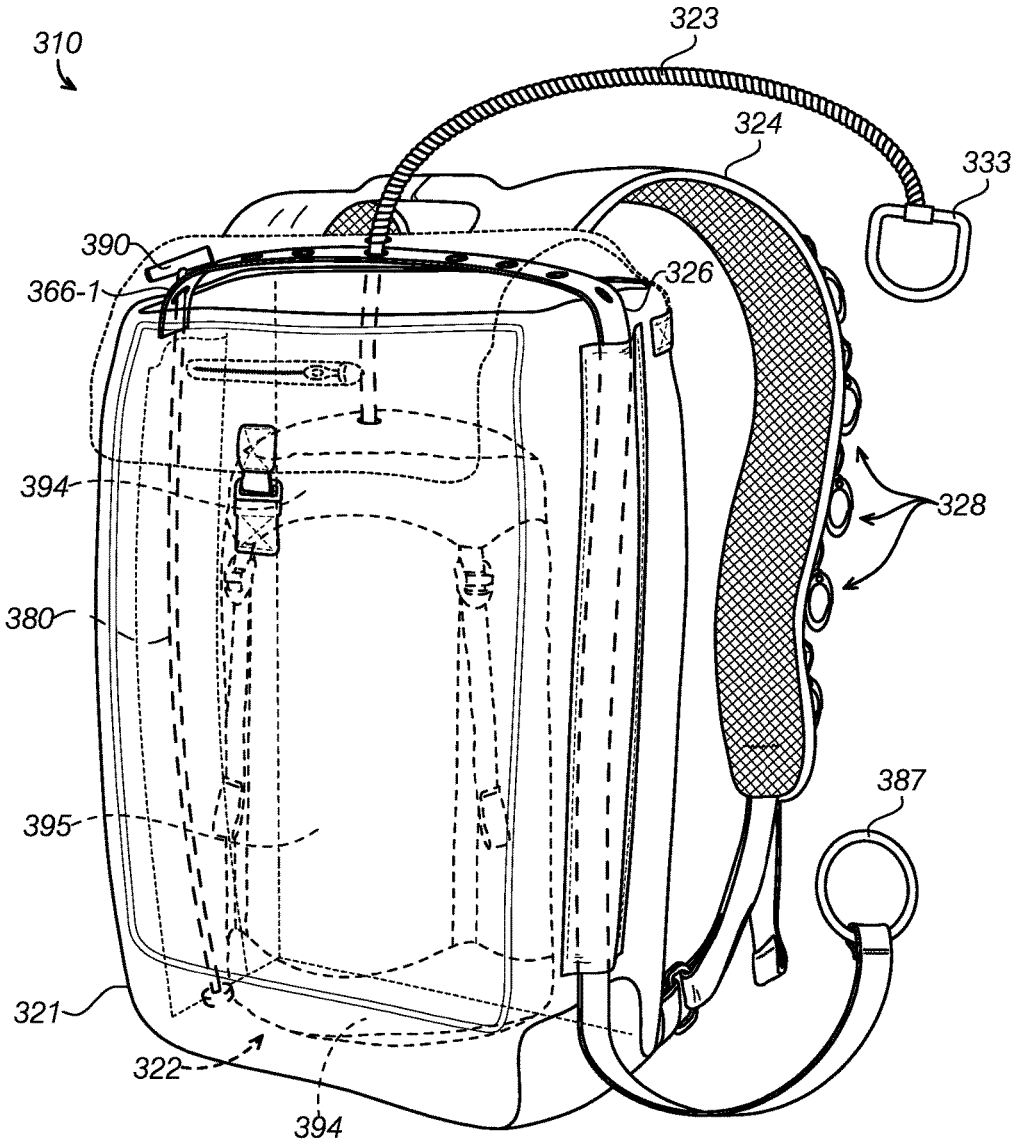
FIG. 6 is a rear perspective of a fourth preferred embodiment of the backpack.

In FIG. 6, a fourth preferred embodiment of a pack 310 comprises a biasing mechanism 380 coupled to a laterally adjusting belt 326. The biasing mechanism 380 preferably comprises a bungee cord 380 inserted through one of the notches 366-1 of the laterally adjusting belt 326 with having a toggle 390 at a free end opposite to the bottom end of the bungee cord 180 anchored to the outer bag 321.

In this preferred embodiment, the laterally adjusting belt 326 may comprise a belt shape and a handle 387 distinguishable from that of the vertically adjusting belt 323 and its corresponding handle 333. As an example and not by way of limitation, the laterally adjusting belt 326 may comprise a flat strap coupled to a laterally adjusting handle 387 preferably comprising a ring. The vertically adjusting belt 323 may comprise a rope 323 coupled to a vertically adjusting handle 333 shaped as a D-ring. While the configurations of the belts and associated handles may vary, it should be expressly understood that forming the belts and corresponding handles with preferably different shapes, sizes and configurations provides the user with tactile recognition of the vertical and horizontal adjustment mechanisms and the convenience of distinguishing between the mechanisms without having to see them.

Figure 7:
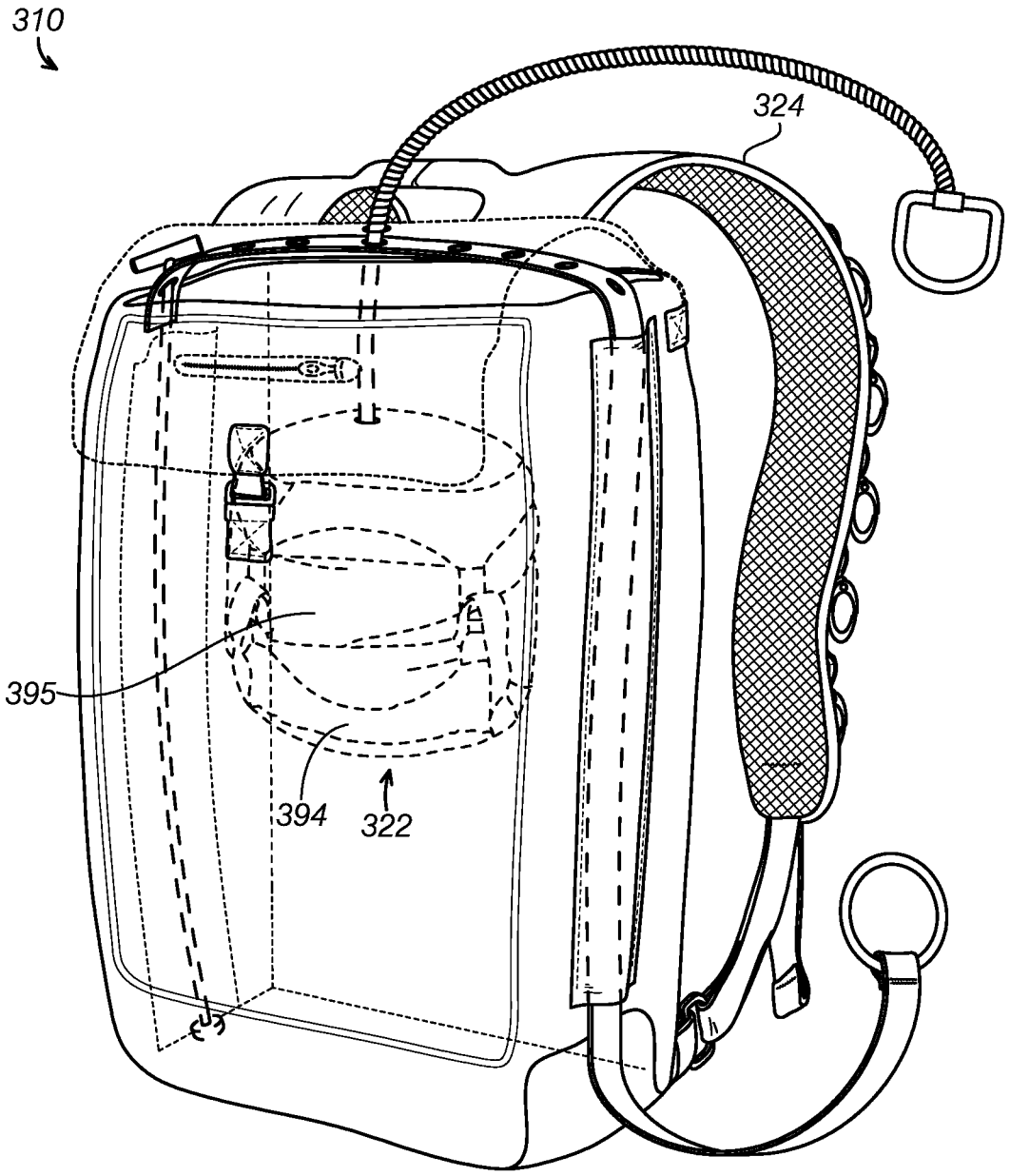
FIG. 7 is a rear perspective of the fourth preferred embodiment of the backpack with a compressed inner bag.

The inner bag 322 in this preferred pack 310 may preferably comprise a compression sack having a cover 394 and an inner pouch 395. As shown in FIG. 7, the compression sack 322 may be compressed to a significantly smaller size than the uncompressed, larger size of the inner bag 322 shown in FIG. 6.

Figure 8:
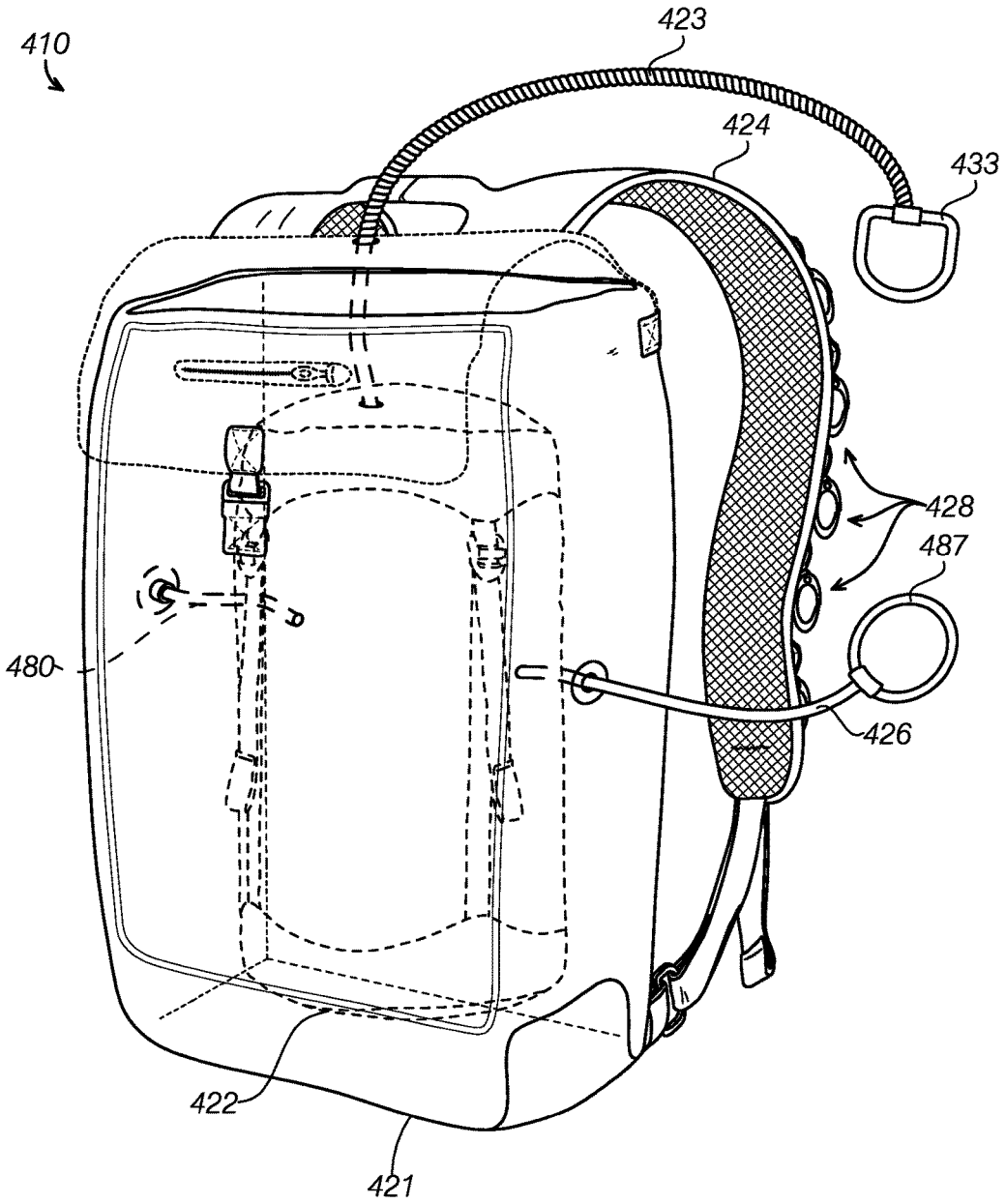
FIG. 8 is a rear perspective of a fifth preferred embodiment of the backpack having an internal biasing mechanism laterally biasing the inner bag.
Figure 9:
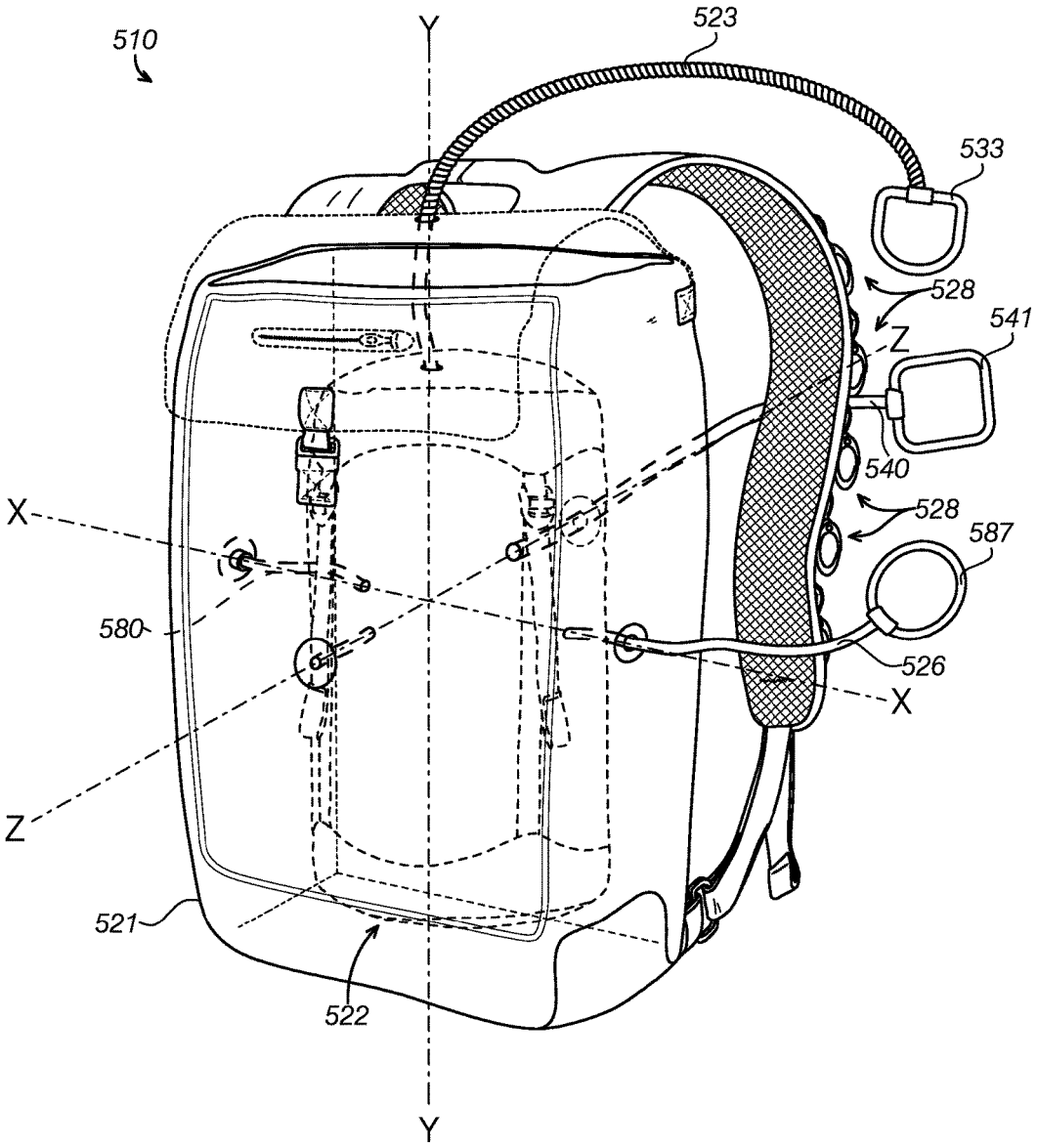
FIG. 9 is a rear perspective of a sixth preferred embodiment of the backpack having internal biasing mechanisms biasing the inner bag laterally and forwardly-rearwardly.

FIGS. 8 and 9 illustrate preferred embodiments where a biasing mechanism, such as a bungee cord, may be used to adjust the position of the inner bag preferably laterally, such as that shown in FIG. 8, and forwardly-rearwardly such as that shown in FIG. 9.

In FIG. 8, a bungee cord 480 is anchored to a left side of the bag while the opposite end is coupled to the inner bag 422 which may comprise a compression sack. A laterally adjusting belt 426 coupled to a right side of the inner bag 422 extends through an opening in the right side of the outer main body 421. A handle 487 coupled to the laterally adjusting belt 426 may comprise a ring. A vertically adjusting belt 423 coupled to a top of the inner bag 422 extends through a top of the outer main body 421 and terminates at a grip 433 which may comprise a D-ring, namely a grip having a different configuration than that of the laterally adjusting handle 487.

In this preferred embodiment, it will be appreciated that the inner bag 421 is laterally biased to the left (i.e., location of the bungee cord 480) and may be moved to the right against the bias by manually pulling the laterally adjusting belt 426. A variety of clasps, fasteners and other connectors may be provided along the straps 424 to enable attachment of the handles 433, 487 at the desired position.

FIG. 9 shows a preferred embodiment of a pack 510 that is biased along both the X-axis (lateral) and the Z-axis (forward-backward). A first bungee cord 580 is coupled to a left portion of the inner bag 521 to bias the inner bag towards the left of the outer main body 521 along the X-axis in a similar manner to that of the embodiment in FIG. 8. A laterally adjusting belt 526 with a corresponding handle 587 enables the user to position the inner bag 521 laterally to a desired lateral position with respect to the outer main body 521.

A second bungee cord is anchored to the rear of the outer main body 521 and coupled to the rear of the inner bag 522 to bias the inner bag towards the rear of the main body 521 along the Z-axis. A forward-rearward adjusting belt 540 is coupled to a front portion of the inner bag 522 to enable the user to adjust the forward/rearward position of the inner bag 522 with respect to the outer body 521. A handle 541 shaped as a square is coupled to the forward-rearward adjusting belt 540.

Figure 10:
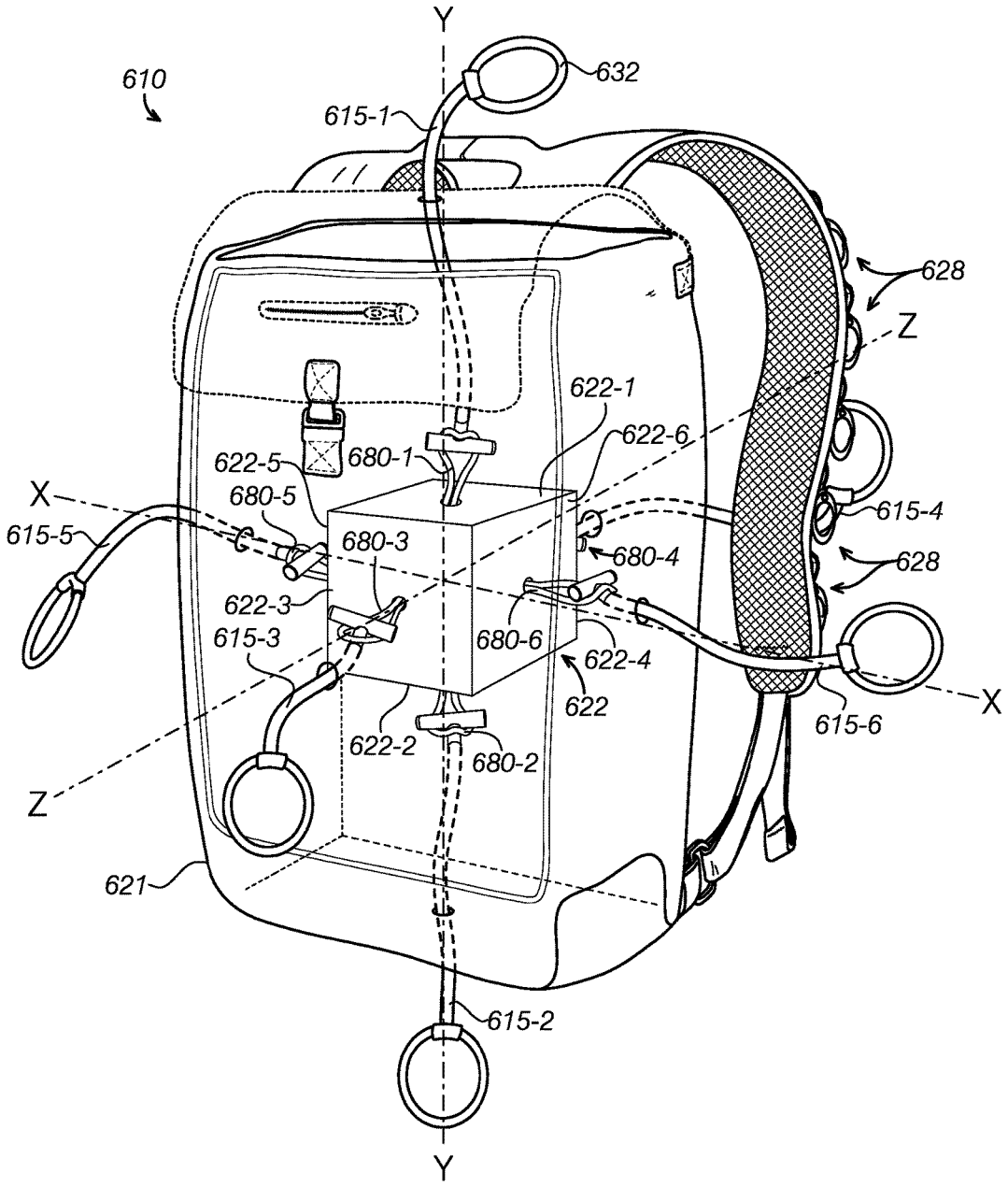
FIG. 10 is a rear perspective of a seventh preferred embodiment of the backpack having internal biasing mechanisms along X, Y and Z axes in multiple directions.

FIG. 10 shows a preferred embodiment of a pack 610 with an inner bag 621. For conceptual purposes, the inner bag 621 is generally illustrated as a cube with six surfaces to show how biasing mechanisms may be attached along each of the X, Y and Z axes in opposite directions. It is to be expressly understood that the inner bag 621 may come in a variety of shapes and sizes. A biasing mechanism, such as a bungee cord loop, is coupled to each surface. In particular, a top bungee cord loop 680-1 is coupled to a top surface 622-1 of the inner body 622 and a top adjusting belt 615-1; a bottom bungee cord loop 680-2 is coupled to a bottom inner body surface 622-2 and a bottom adjusting belt 615-2; a rear bungee cord loop 680-3 is coupled to a rear inner body surface 622-3 and a rear adjusting belt 615-3; a front bungee cord loop 680-4 is coupled to a front inner body surface 622-4 and a front adjusting belt 615-4; a left bungee cord loop 680-5 is coupled to a left inner body surface 622-5 and a left adjusting belt 615-5; and a right bungee cord loop 680-6 is coupled to a right inner body surface 622-6 and a right adjusting belt 615-6. Each belt 615-1 to 615-6 preferably includes a toggle inserted through the respective belt loop to attach each corresponding bungee cord loop. Each belt 615-1 to 615-6 preferably comprises a grip or handle 632 at the opposite free end disposed outside the outer main body 621 which can be coupled to the clasps 628 disposed along the shoulder straps 624.

Thus, the pack 610 is biased and maneuverable along the X, Y and Z axes so as to enable the inner bag to be three-dimensionally positioned (e.g., vertically, laterally, forwardly-rearwardly) anywhere within the outer main body 621.

In all of the above embodiments, the belts disclosed may comprise a waterproof material or include a waterproof cover. Furthermore, each belt may include other distinguishing features to enable the user to quickly distinguish one belt's function from another. In addition to the different grips and shapes of belts discussed above, different colors may be used. For example, a vertically adjusting belt may comprise a first color while a laterally adjusting belt may comprise a second color different from the first color.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A bag apparatus, comprising:
an outer main body;
an inner bag disposed within the main body; and
an inner bag adjustment mechanism coupled to the inner bag and configured to steplessly move and fix the inner bag with respect to the outer main body, the inner bag adjustment mechanism comprising:
a first belt coupled to the inner bag and configured to adjust a vertical position of the inner bag with respect to the outer main body; and
a second belt configured to adjust a lateral position of the inner bag with respect to the outer main body, wherein the second belt moves the first belt laterally towards the right or left side of the main body.

2. The apparatus of claim 1, further comprising a first securing mechanism to releasably fix the inner bag at the vertical position.

3. The apparatus of claim 2, wherein the first securing mechanism comprises a first plurality of hook-and-loop fasteners formed on a handle of the first belt.

4. The apparatus of claim 3, further comprising a pair of shoulder straps having a second plurality of hook-and-loop fasteners, wherein the first plurality of hook-and-loop fasteners may be releasably coupled to the second plurality of hook-and-loop fasteners.

5. The apparatus of claim 2, further comprising a second securing mechanism to releasably fix the inner bag at the lateral position.

6. The apparatus of claim 1, wherein the second belt comprises a ring through which the first belt passes, the ring moving the first belt laterally so as to adjust the lateral position of inner bag.

7. The apparatus of claim 1, further comprising a biasing mechanism coupled to the second belt.

8. The apparatus of claim 1, wherein the inner bag adjustment mechanism may be employed while the bag apparatus is worn.

9. The apparatus of claim 1, wherein the inner bag is adjustable in size.

10. A bag apparatus, comprising:
an outer main body;
an inner bag disposed within the main body;
an inner bag adjustment mechanism coupled to the inner bag and configured to move the inner bag both vertically and laterally with respect to the outer main body; and
a first securing mechanism to releasably fix the inner bag at a desired vertical position,
wherein the inner bag adjustment mechanism comprises a first belt configured to adjust a vertical position of the inner bag with respect to the outer main body and a second belt configured to adjust a lateral position of the inner bag with respect to the outer main body, and
wherein the first belt is coupled to the inner bag and the second belt moves the first belt laterally towards the right or left side of the main body.

11. The apparatus of claim 10, wherein the first securing mechanism comprises a first plurality of hook-and-loop fasteners formed on a handle of the first belt, the apparatus further comprising a pair of shoulder straps having a second plurality of hook-and-loop fasteners, wherein the first plurality of hook-and-loop fasteners may be releasably coupled to the second plurality of hook-and-loop fasteners.

12. The apparatus of claim 10, further comprising a second securing mechanism to releasably fix the inner bag at a desired lateral position.

13. The apparatus of claim 10, wherein the second belt comprises a ring through which the first belt passes, the ring moving the first belt laterally so as to adjust the lateral position of inner bag.

14. The apparatus of claim 10, further comprising a biasing mechanism coupled to the first belt.

15. The apparatus of claim 14, wherein the biasing mechanism comprises a first biasing mechanism, the apparatus further comprising a second biasing mechanism coupled to the second belt.

16. A bag apparatus, comprising:
an outer main body;
an inner bag disposed within the main body;
an inner bag adjustment mechanism coupled to the inner bag and configured to move the inner bag both vertically and laterally with respect to the outer main body;
a first securing mechanism to releasably fix the inner bag at a desired vertical position;
a second securing mechanism to releasably fix the inner bag at a desired lateral position; and
a pair of shoulder straps,
wherein the inner bag adjustment mechanism comprises a first belt configured to adjust a vertical position of the inner bag with respect to the outer main body and a second belt configured to adjust a lateral position of the inner bag with respect to the outer main body, and wherein the first belt is coupled to the inner bag and the second belt moves the first belt laterally towards the right or left side of the main body.

17. The apparatus of claim 16, wherein:

the first securing mechanism comprises a first plurality of hook-and-loop fasteners formed on a handle of the first belt, and wherein the pair of shoulder straps comprise a second plurality of hook-and-loop fasteners such that the first plurality of hook-and-loop fasteners may be releasably coupled to the second plurality of hook-and-loop fasteners.

18. The apparatus of claim 16, wherein the second belt comprises a ring through which the first belt passes, the ring moving the first belt laterally so as to adjust the lateral position of inner bag.

19. The apparatus of claim 16, further comprising a biasing mechanism coupled to the second belt.

* * * * *